US009522534B2

(12) United States Patent
Domae

(10) Patent No.: US 9,522,534 B2
(45) **Date of Patent: *Dec. 20, 2016**

(54) LIQUID JET HEAD AND LIQUID JET APPARATUS

(71) Applicant: SII PRINTEK INC., Chiba-shi, Chiba (JP)

(72) Inventor: Yoshinori Domae, Chiba-shi, Chiba (JP)

(73) Assignee: SII PRINTEK INC. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/570,071

(22) Filed: Dec. 15, 2014

(65) Prior Publication Data

US 2015/0174903 A1 Jun. 25, 2015

(30) Foreign Application Priority Data

Dec. 24, 2013 (JP) ..... 2013-265514

(51) Int. Cl.
*B41J 2/015* (2006.01)
*B41J 2/14* (2006.01)
*B41J 2/16* (2006.01)

(52) U.S. Cl.
CPC ..... *B41J 2/14201* (2013.01); *B41J 2/14209* (2013.01); *B41J 2/1609* (2013.01); *B41J 2/1623* (2013.01); *B41J 2/1632* (2013.01); *B41J 2002/14411* (2013.01); *B41J 2002/14491* (2013.01); *B41J 2202/12* (2013.01)

(58) Field of Classification Search
None
See application file for complete search history.

(56) References Cited

U.S. PATENT DOCUMENTS

2003/0193550 A1* 10/2003 Harajiri et al. ..... B41J 2/14209 347/68

FOREIGN PATENT DOCUMENTS

| | | |
|---|---|---|
| JP | 7205422 | 8/1995 |
| JP | 8258261 | 10/1996 |
| JP | 10 86369 | 4/1998 |
| JP | 11314362 | 11/1999 |
| JP | 2009500209 | 1/2009 |
| JP | 2014 87949 | 5/2014 |

OTHER PUBLICATIONS

European Search Report mailed May 8, 2015 issued in Appln. No. EP 14 19 9847.661.

* cited by examiner

*Primary Examiner* — Erica Lin
(74) *Attorney, Agent, or Firm* — Adams & Wilks

(57) ABSTRACT

A liquid jet head includes a piezoelectric body substrate including a plurality of groove arrays in which a long and narrow ejection groove and a long and narrow non-ejection groove are alternately arrayed in a reference direction. The other side end portion of the ejection groove included in a one side groove array, and a one side end portion of the non-ejection groove included in the other side groove array do not overlap in a thickness direction of the piezoelectric body substrate, and the other side end portion of the ejection groove included in the one side groove array, and a one side end portion of the ejection groove included in the other side groove array communicate, or overlap in the reference direction, of adjacent groove arrays.

18 Claims, 8 Drawing Sheets

LIQUID JET HEAD AND LIQUID JET APPARATUS

BACKGROUND

Technical Field

The present invention relates to a liquid jet head and a liquid jet apparatus that jet and record liquid droplets on a recording medium.

Related Art

In recent years, liquid jet heads of an ink jet system, which eject ink droplets on a recording paper or the like to record characters and figures, or eject a liquid material on a surface of an element substrate to forma functional thin film, are used. This system introduces a liquid such as ink or the liquid material from a liquid tank to a channel through a supply tube, and applies pressure to the liquid, which is filled in the channel, to eject the liquid through a nozzle communicated with the channel. When ejecting the liquid, the system moves a liquid jet head and a recording medium to record the characters and figures or to form a functional thin film having a predetermined shape.

FIGS. 9A and 9B are explanatory diagrams of this sort of liquid jet head described in JP 2009-500209 W. FIG. 9A is a schematic cross-sectional view of a channel portion, and FIG. 9B is a perspective view of the channel portion from which a nozzle plate is removed. A piezoelectric material 1501 is provided on a base 1502. The piezoelectric material 1501 includes discharge channels 1508 and non-discharge channels 1510 that are partitioned by operation side walls 1507 and are alternately arranged. Channel extending areas 1504 are continuously provided at upper portions of the discharge channels 1508, and open upward. The discharge channels 1508 and the non-discharge channels 1510 alternately open upward and downward. A nozzle plate 1505 in which nozzles 1506 open adheres to an upper portion of the channel extending areas 1504. That is, a side shooter type liquid jet head that discharges liquid droplets from the discharge channels 1508 to a surface of the base 1502 in a vertical direction is provided. A liquid such as ink is circulated and filled from one side to the other side of a longitudinal direction of the channels. Electrodes 1511 are formed on surfaces of the operation side walls 1507 that partition the discharge channels 1508 and the non-discharge channels 1510. A drive signal is applied to the electrodes 1511 and the operation side walls 1507 are operated, pressure is applied to the ink in the discharge channels 1508, and the ink droplets are ejected through the nozzles 1506.

JP 07-205422 A, JP 08-258261 A, JP 11-314362 A, and JP 10-86369 A describe liquid jet heads in which grooves that serve as channels alternately open in an up and down direction of the longitudinal direction of the channels, similarly to JP 2009-500209 W. In JP 07-205422 A, JP 08-258261 A, JP 11-314362 A, and JP 10-86369 A, edge shooter type liquid jet heads formed of channel rows arranged in a line in a direction perpendicular to the longitudinal direction of the channels, and which discharge the liquid droplets from one side end portions of the longitudinal direction of discharge channels, are described.

Although JP 2009-500209 W describes the channel rows arranged in a line in the direction perpendicular to the longitudinal direction of the channels, JP 2009-500209 W does not describe forming a plurality of channel rows, or forming narrow intervals of the plurality of channel rows with high density. Similarly, JP 07-205422 A, JP 08-258261 A, JP 11-314362 A, and JP 10-86369 A do not describe forming a plurality of channel rows, and forming narrow intervals of the plurality of channel rows.

Further, in the liquid jet head described in JP 2009-500209 W, the liquid is filled in both of the discharge channels 1508 and the non-discharge channels 1510, and thus the liquid comes in contact with surfaces of the electrodes of the both channels. Therefore, when a conductive ejection liquid is used, it is necessary to install protective films or the like on the surfaces of the electrodes 1511 and the base 1502, and therefore, a manufacturing process steps become complicated and long.

SUMMARY

A liquid jet head of the present invention includes a piezoelectric body substrate including a plurality of groove arrays in which a long and narrow ejection groove and a long and narrow non-ejection groove are alternately arrayed in a reference direction. Of the adjacent groove arrays of the liquid jet head, the other side end portion of the ejection groove included in the groove array of one side, and a one side end portion of the non-ejection groove included in the groove array of the other side do not overlap in a thickness direction of the piezoelectric body substrate, and the other side end portion of the ejection groove included in the groove array of the one side and a one side end portion of the ejection groove included in the groove array of the other side communicate, or overlap in the reference direction.

Further, of the adjacent groove arrays, the other side end portion of the non-ejection groove included in the groove array of the one side, and the one side end portion of the non-ejection groove included in the groove array of the other side communicate or overlap in the reference direction.

Further, of the adjacent groove arrays, the other side end portion of the ejection groove included in the groove array of the one side includes a slope rising to a side of an upper surface of the piezoelectric body substrate, and the other side end portion of the non-ejection groove included in the groove array of the one side includes a slope falling to a side of a lower surface at an opposite side to the upper surface of the piezoelectric body substrate Further, of the adjacent groove arrays, the one side end portion of the non-ejection groove included in the groove array of the one side open to a side surface of the piezoelectric body substrate.

A closest approach distance between the ejection groove included in the groove array of the one side and the non-ejection groove included in the groove array of the other side does not fall below 10 μm.

Further, a cover plate including a liquid chamber that communicates with the ejection groove, and bonded on an upper surface of the piezoelectric body substrate is included.

The liquid chamber includes a common liquid chamber that communicates with the other side end portion of the ejection groove included in the groove array of the one side.

Further, the liquid chamber includes an individual liquid chamber that communicates with the one side end portion of the ejection groove included in the groove array of the one side.

Further, a nozzle plate including a plurality of nozzle arrays in which nozzles that communicate with the ejection grooves corresponding to the groove arrays, and bonded on a lower surface of the piezoelectric body substrate is included.

Further, drive electrodes of the ejection groove and of the non-ejection groove are not installed on side surfaces closer to an upper surface than approximately ½ of a thickness of the piezoelectric body substrate, and are installed on side surfaces closer to a lower surface than approximately ½ of the thickness of the piezoelectric body substrate.

Further, the drive electrode installed on the ejection groove is positioned, in a groove direction, within a region of an opening portion in the lower surface of the piezoelectric body substrate, to which the ejection groove opens.

A liquid jet apparatus of the present invention includes the above-described liquid jet head; a moving mechanism configured to relatively move the liquid jet head and a recording medium; a liquid supply tube configured to supply a liquid to the liquid jet head; and a liquid tank configured to supply the liquid to the liquid supply tube.

The liquid jet head according to the present invention includes a piezoelectric body substrate including a plurality of groove arrays in which long and narrow ejection grooves and long and narrow non-ejection grooves are alternately arrayed in a reference direction. Of adjacent groove arrays of the liquid jet head, the other side end portions of the ejection grooves included in a one side groove array, and one side end portions of the non-ejection grooves included in the other side groove array do not overlap in a thickness direction of the piezoelectric body substrate, and the other side end portions of the ejection grooves included in the one side groove array, and one side end portions of the ejection grooves included in the other side groove array communicate or overlap in the reference direction. Accordingly, the ejection grooves are arranged with high density, the number of piezoelectric body substrates 2 to be taken from a piezoelectric body wafer is increased, and manufacturing cost is decreased. Further, the structure of the cover plate bonded on the upper surface of the piezoelectric body substrate is simplified.

DETAILED DESCRIPTION (First Embodiment)

Figure 1:
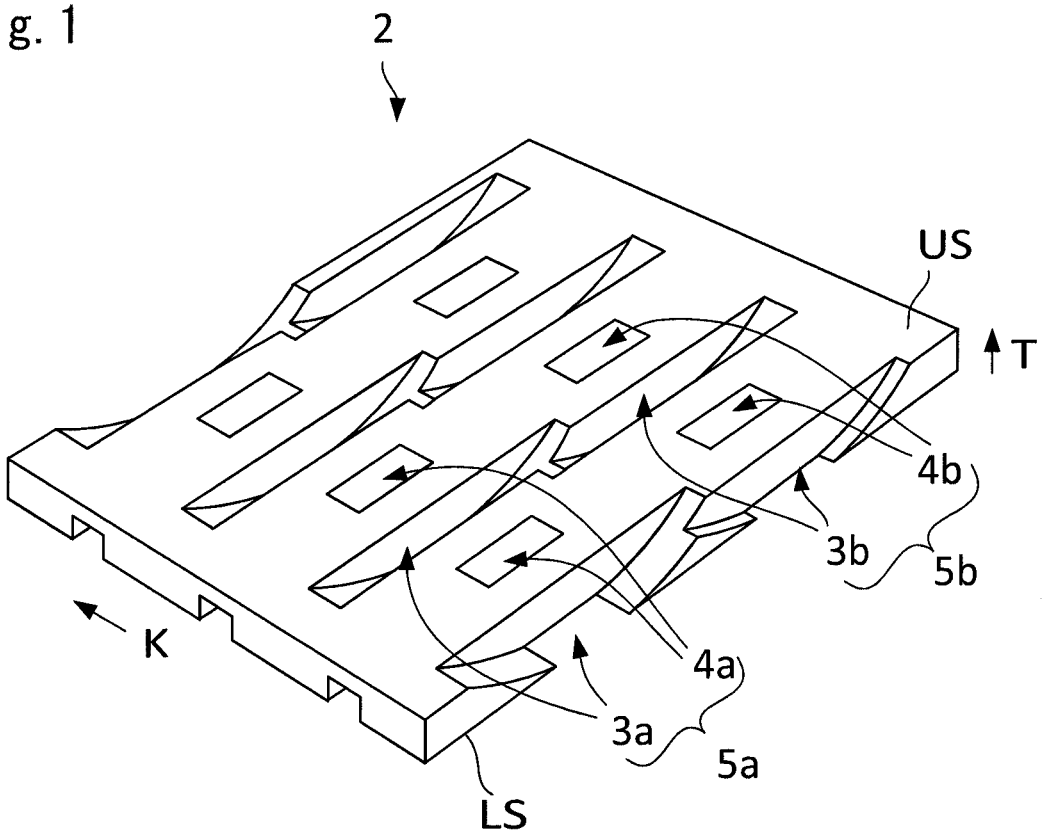
FIG. 1 is a schematic perspective view of a piezoelectric body substrate of a liquid jet head according to a first embodiment of the present invention.
Figure 2A:
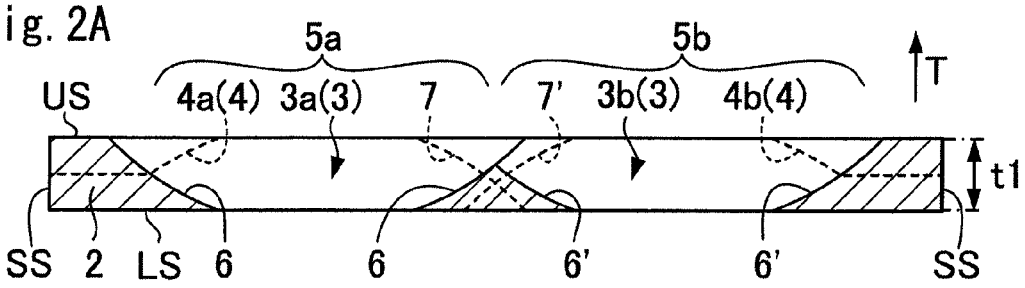
FIGS. 2A and 2B are explanatory diagrams of the piezoelectric body substrate of the liquid jet head according to the first embodiment of the present invention.
Figure 2B:
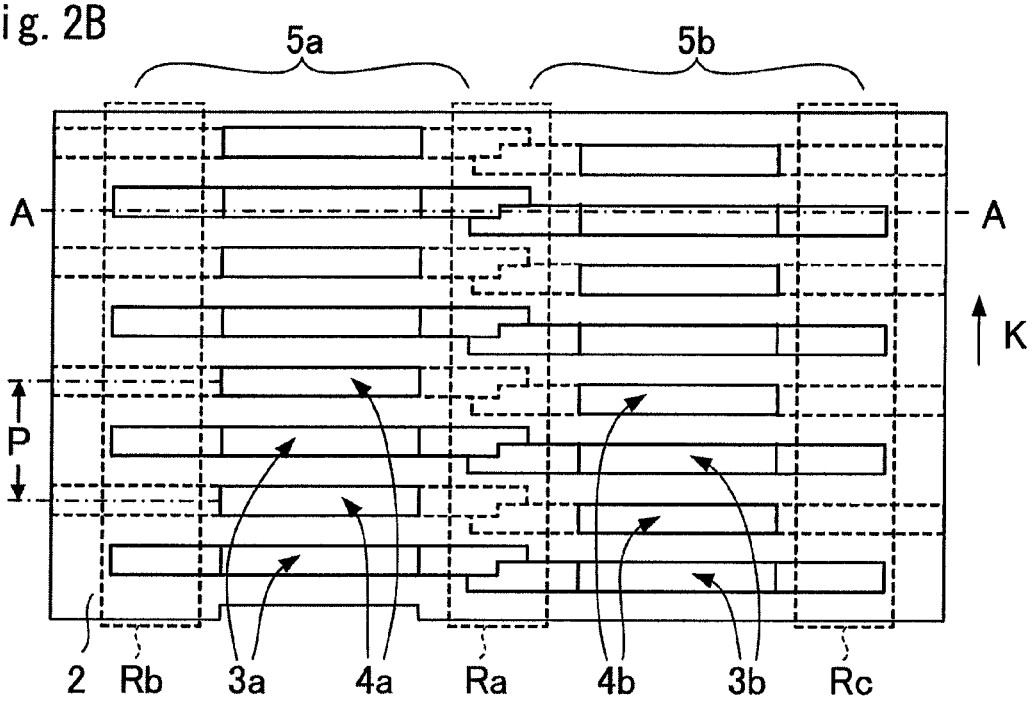

FIG. 1 is a schematic perspective view of a piezoelectric body substrate 2 of a liquid jet head according to a first embodiment of the present invention. FIGS. 2A and 2B are explanatory diagrams of the piezoelectric body substrate 2 of the liquid jet head according to the first embodiment of the present invention. FIG. 2A is a schematic cross-sectional view of the piezoelectric body substrate 2 in a groove direction, and FIG. 2B is a partial upper surface schematic diagram of the piezoelectric body substrate 2. Note that the liquid jet head is configured such that a cover plate is installed on an upper surface US of the piezoelectric body substrate 2, and a nozzle plate is installed on a lower surface LS of the piezoelectric body substrate 2. In the first embodiment, the piezoelectric body substrate 2 that is a basic component of the present invention will be described.

As illustrated in FIG. 1, the piezoelectric body substrate 2 includes a first groove array 5*a* in which long and narrow first ejection grooves 3*a* and long and narrow first non-ejection grooves 4*a* are alternately arrayed in a reference direction K, and a second groove array 5*b* in which long and narrow second ejection grooves 3*b* and long and narrow second non-ejection grooves 4*b* are alternately arrayed in the reference direction K, adjacent to each other. Of the adjacent first and second groove arrays 5*a* and 5*b*, the other side end portions of the first ejection grooves 3*a* included in the first groove array 5*a*, and one side end portions of the second non-ejection grooves 4*b* included in the second groove array 5*b* do not overlap in a thickness direction T of the piezoelectric body substrate 2. Similarly, of the adjacent first and second groove arrays 5*a* and 5*b*, the other side end portions of the first non-ejection grooves 4*a* included in the first groove array 5*a*, and one side end portions of the second ejection grooves 3*b* included in the second groove array 5*b* do not overlap in the thickness direction T of the piezoelectric body substrate 2. Then, the other side end portions of the first ejection grooves 3*a* included in the first groove array 5*a*, and the one side end portions of the second ejection grooves 3*b* included in the second groove array 5*b* communicate. Similarly, the other side end portions of the first non-ejection grooves 4*a* included in the first groove array 5*a*, and the one side end portions of the second non-ejection grooves 4*b* included in the second groove array 5*b* communicate.

As described above, the first ejection grooves 3*a* and the second ejection grooves 3*b*, and the first non-ejection grooves 4*a* and the second non-ejection grooves 4*b* respectively communicate; and the first groove array 5*a* and the second groove array 5*b* are closely adjacent. Accordingly, the ejection grooves are arranged with high density, the number of piezoelectric body substrates 2 to be taken from a piezoelectric body wafer can be increased, and manufacturing cost can be decreased.

Specific description will be given with reference to FIGS. 2A and 2B. FIG. 2A illustrates cross section shapes of the first ejection groove 3*a* and the second ejection groove 3*b* (a cross section of an AA portion of FIG. 2B). The first non-ejection groove 4*a* and the second non-ejection groove 4*b* adjacent in the reference direction K (a depth direction on the page) are illustrated by broken lines. As the piezoelectric body substrate 2, a lead zirconate titanate (PZT) ceramic can be used. At least side walls of the piezoelectric body substrate 2, the side walls functioning as drive walls, may just be made of a piezoelectric body material. Even if a non-piezoelectric material is used in a peripheral region where the ejection grooves 3 and the non-ejection grooves 4 are not formed or in a region corresponding to a liquid chamber 9 (see FIG. 5) in the cover plate 8, the substrate is herein called piezoelectric body substrate 2. The grooves are cut and formed with a dicing blade (also called diamond blade) having cutting abrasive embedded in a periphery of a disk. The first ejection grooves 3*a* and the second ejection grooves 3*b* are cut from the upper surface US toward the lower surface LS of the piezoelectric body substrate 2, and the first non-ejection grooves 4*a* and the second non-ejection grooves 4*b* are cut from the lower surface LS toward the upper surface US of the piezoelectric body substrate 2. Therefore, the first and second ejection grooves 3*a* and 3*b* form protruding shapes from the upper surface US toward the lower surface LS, and the first and second non-ejection grooves 4*a* and 4*b* form protruding shapes from the lower surface LS toward upper surface US.

All of the first and second ejection grooves 3*a* and 3*b* and the first and second non-ejection grooves 4*a* and 4*b* penetrate from the upper surface US to the lower surface LS of the piezoelectric body substrate 2. Note that, in the present invention, it is essential that the first and second non-ejection grooves 4*a* and 4*b* open to the side of the lower surface LS, but it is not essential that the first and second non-ejection grooves 4*a* and 4*b* open to the side of the upper surface US. Openings of the first and second ejection grooves 3*a* and 3*b* of the upper surface US side are larger than openings of the lower surface LS side. Similarly, openings of the first and second non-ejection grooves 4*a* and 4*b* of the lower surface LS side are larger than openings of the upper surface US side. To be more specific, end portions of the first and second ejection grooves 3*a* and 3*b* form slopes 6 and 6' rising to the upper surface US side of the piezoelectric body substrate 2, and end portions of the first and second non-ejection grooves 4*a* and 4*b* form slopes 7 and 7' falling to the lower surface LS of the piezoelectric body substrate 2.

As illustrated in FIG. 2B, the piezoelectric body substrate 2 includes the first groove array 5*a* and the second groove array 5*b* that are parallel in the reference direction K. The first ejection groove 3*a* and the first non-ejection groove 4*a*, and the second ejection groove 3*b* and the second non-ejection groove 4*b* are alternately arrayed in the reference direction K at equal intervals. The first groove array 5*a* and the second groove array 5*b* are installed by being shifted by appropriately (P/8) pitches in the reference direction K, where an arraying pitch of the first ejection grooves 3*a* is a pitch P (an arraying pitch of the second ejection grooves 3*b* is the same). Then, the first ejection grooves 3*a* and the second ejection grooves 3*b* communicate, and the first non-ejection grooves 4*a* and the second non-ejection grooves 4*b* communicate, whereby the interval between the first groove array 5*a* and the second groove array 5*b* is made narrow.

Further, the one side end portions of the first non-ejection grooves 4*a* open to one side surface SS of the piezoelectric body substrate 2. Similarly, the other side end portions of the second non-ejection grooves 4*b* open to the other side surface SS of the piezoelectric body substrate 2. As described above, the non-ejection grooves 4 are caused to open to the side surfaces SS of the piezoelectric body substrate 2, whereby drive electrodes 13 (see FIG. 6) installed at side surfaces of the non-ejection grooves 4 can be easily pulled out to the lower surface LS in the vicinities of the side surfaces SS.

Here, a closest approach distance between the first ejection groove 3*a* and the second non-ejection groove 4*b* does not fall below 10 μm. Similarly, a closest approach distance between the first non-ejection groove 4*a* and the second ejection groove 3*b* does not fall below 10 μm. If the distance between the ejection groove 3 and the non-ejection groove 4 falls below 10 μm, the ejection groove 3 and the non-ejection groove 4 may sometimes communicate through a void existing in the piezoelectric body substrate 2, and thus the distances are employed in order to avoid the communication.

For example, groove shapes of the first and second ejection grooves 3*a* and 3*b* and groove shapes of the first and second non-ejection grooves 4*a* and 4*b* are the same shape when the groove shapes are inverted upside down, excluding the vicinities of the side surfaces SS, and the thickness t1 of the piezoelectric body substrate 2, that is, the depth of the first and second ejection grooves 3*a* and 3*b*, and of the first and second non-ejection grooves 4*a* and 4*b* are 360 μm, for example. When the grooves are cut using a dicing blade having a radius of 25.7 mm, for example, the length of the slopes 6 and 6' and of the slopes 7 and 7' in the groove direction is about 3.5 mm. Therefore, if the slope 6 of the other side end portion of the first ejection groove 3*a* and the slope 6' of the one side end portion of the second ejection groove 3*b* are layered and formed in the reference direction K, and similarly, the slope 7 of the other side end portion of the first non-ejection groove 4*a* and the slope 7' of the one side end portion of the second non-ejection groove 4*b* are layered and formed in the reference direction K, a total length of the first groove array 5*a* and the second groove array 5*b* in the groove direction can be shortened by up to about 3.5 mm. Considering that electrode terminals and the like are formed on the upper surface US and the lower surface LS of the piezoelectric body substrate 2, larger shortening effect can be obtained.

Figure 5:
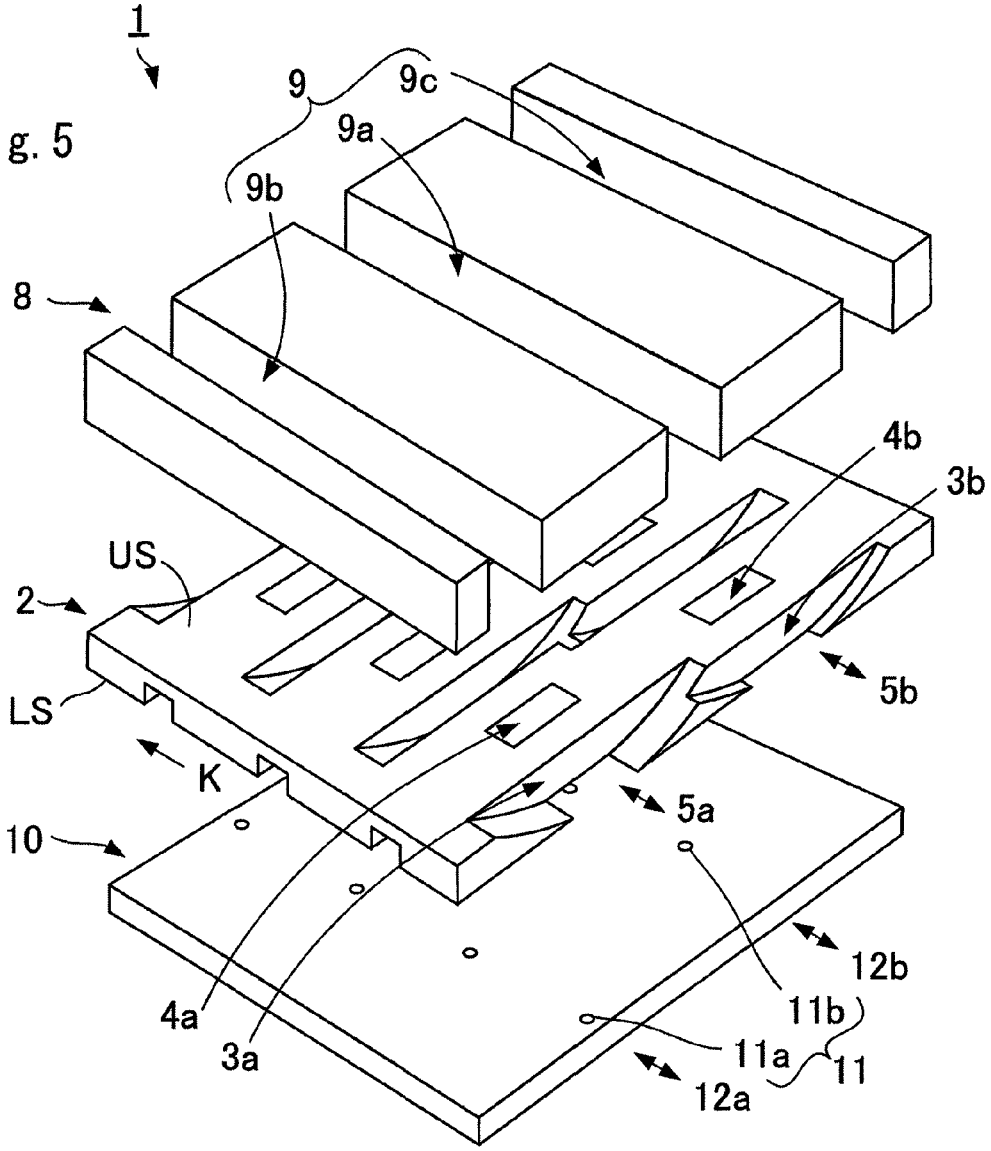
FIG. 5 is a schematic exploded perspective view of a liquid jet head according to a third embodiment of the present invention.
Figure 6:
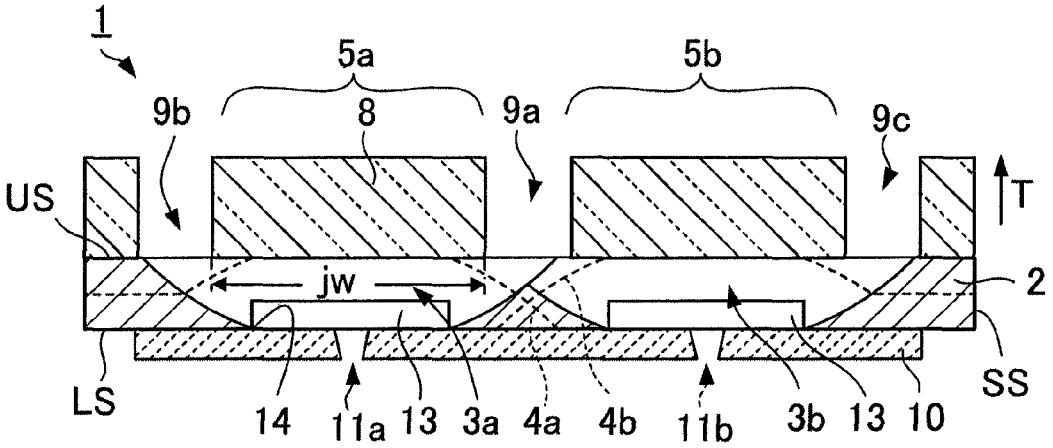
FIG. 6 is a schematic cross-sectional view of the liquid jet head in a groove direction according to the third embodiment of the present invention.

Further, as illustrated in FIG. 2B, the other side end portions of the first ejection grooves 3*a* and the one side end portions of the second ejection grooves 3*b* open to a region Ra, which is between the other side end portions of opening portions in the upper surface US, to which the first non-ejection grooves 4*a* open, and one side end portions of opening portions in the upper surface US, to which the second non-ejection grooves 4*b* open. Further, the first ejection grooves 3*a* open to a region Rb that is closer to the one side of the piezoelectric body substrate 2 than one side end portions of the opening portions in the upper surface US, to which the first non-ejection grooves 4*a* open. Similarly, the second ejection grooves 3*b* open to a region Rc that is closer to the other side of the piezoelectric body substrate 2 than the other side end portions of the opening portions in the upper surface US, to which the second non-ejection groove 4*b* open. If a common liquid chamber 9*a* and two individual liquid chambers 9*b* and 9*c* of the cover plate 8, which are to be described in FIGS. 5 and 6, are respectively installed corresponding to these regions Ra, Rb, and Rc, the first non-ejection grooves 4*a* and the second non-ejection grooves 4*b* do not open to the regions Ra, Rb, and Rc. As a result, it is not necessary to provide slits in the common liquid chamber 9*a* and the two individual liquid chambers 9*b* and 9*c* of the cover plate 8. Therefore, the structure of the cover plate 8 can be simplified.

Further, the depth of the first and second non-ejection grooves 4*a* and 4*b* from the lower surface LS are favorably formed deeper than approximately t1/2 of the thickness t1 of the piezoelectric body substrate 2 in the vicinities of the side surfaces SS of the piezoelectric body substrate 2. Accordingly, the drive electrodes formed on both of the side surfaces of the first or second non-ejection grooves 4*a* or 4*b* can be electrically separated, and pulled out to periphery sides of the piezoelectric body substrate 2. Note that extending of the first and second non-ejection grooves 4*a* and 4*b* to the side surfaces SS is not an essential requirement of the present invention. The first and second non-ejection grooves 4*a* and 4*b* may not be extended to the side surfaces SS, and the first and second non-ejection grooves 4*a* and 4*b* may have the same shape as the first and second ejection grooves 3*a* and 3*b*. Further, while a case where two arrays of the groove arrays has been described, the present invention is not limited to the two arrays of the groove arrays, and three or more arrays of the groove arrays may be installed.

Further, the present invention is not limited to the configuration in which the first groove array 5*a* and the second groove array 5*b* are shifted by the (P/8) pitches in the reference direction K. In the present invention, the other side end portions of the ejection grooves 3 included in the one side groove array 5, and the one side end portions of the non-ejection grooves 4 included in the other side groove array 5 do not overlap in the thickness direction T of the piezoelectric body substrate 2, and the other side end portions of the ejection grooves 3 included in the one side groove array 5, and the one side end portions of the ejection grooves 3 included in the other side groove array 5 communicate, or overlap in the reference direction K. Therefore, positional deviation Δ between the first groove array 5*a* and the second groove array 5*b* in the reference direction K falls within a range of an expression (1):

$$-(P-Wd-Wt)/2<\Delta<+(P-Wd-Wt)/2 \quad (1)$$

where the interval of the ejection grooves 3 in the reference direction K is a pitch P, the groove width of the ejection grooves 3 is Wt, and the groove width of the non-ejection grooves 4 is Wd.

(Second Embodiment)

Figure 3:
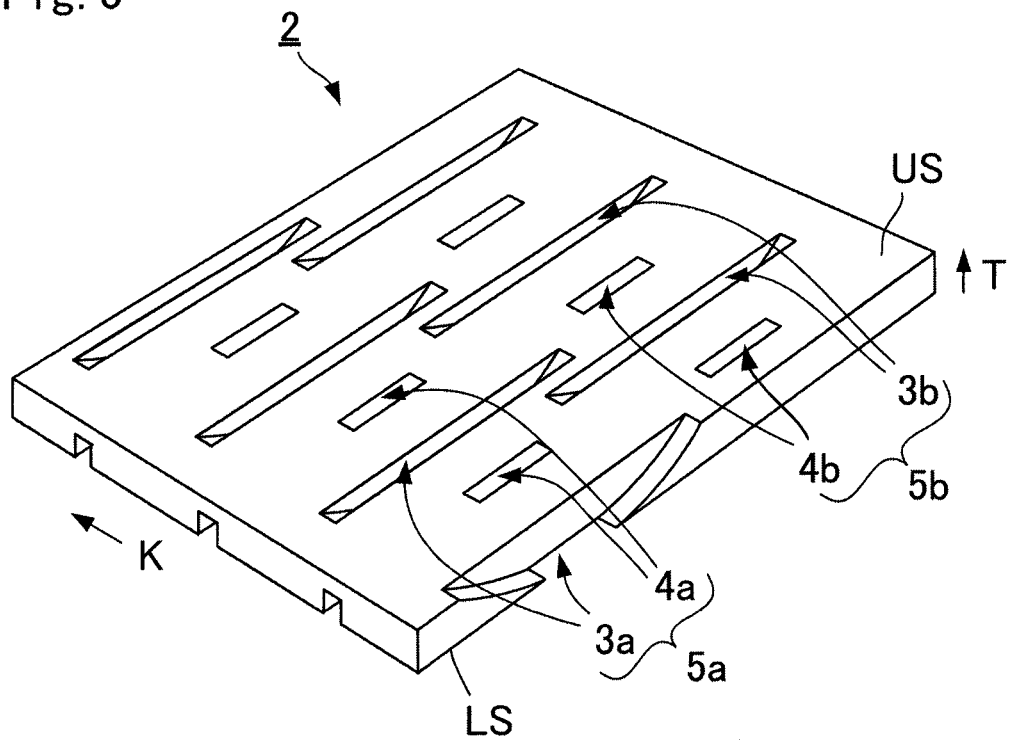
FIG. 3 is a schematic perspective view of a piezoelectric body substrate of a liquid jet head according to a second embodiment of the present invention.
Figure 4A:
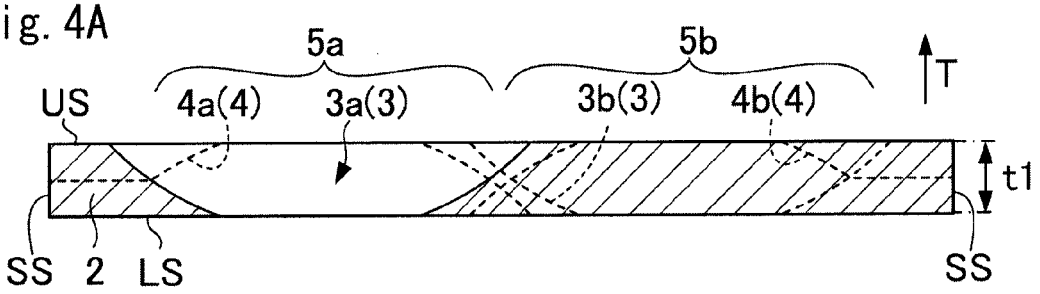
FIGS. 4A and 4B are explanatory diagrams of the piezoelectric body substrate of the liquid jet head according to the second embodiment of the present invention.
Figure 4B:
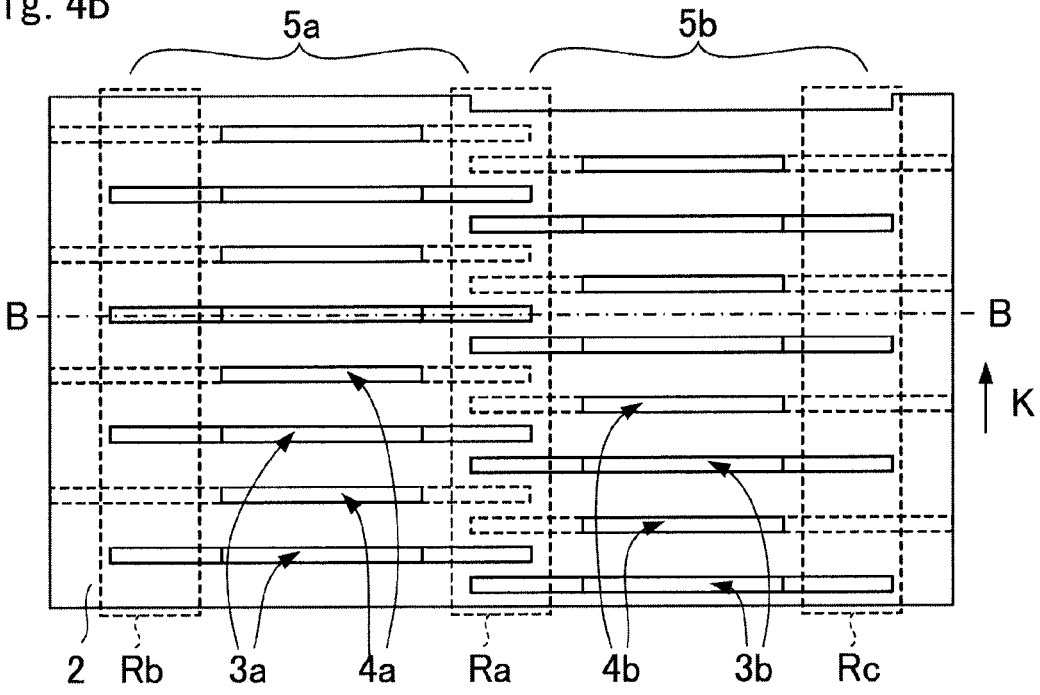

FIG. 3 is a schematic perspective view of a piezoelectric body substrate 2 of a liquid jet head according to a second embodiment of the present invention. FIGS. 4A and 4B are explanatory diagrams the piezoelectric body substrate 2 of the liquid jet head according to the second embodiment of the present invention. FIG. 4A is a schematic cross-sectional view of the piezoelectric body substrate 2 in a groove direction, and FIG. 4B is a partial upper surface schematic diagram of the piezoelectric body substrate 2. Note that the liquid jet head is configured such that a cover plate is installed on an upper surface US of the piezoelectric body substrate 2, and a nozzle plate is installed on a lower surface LS. In the second embodiment, the piezoelectric body substrate 2 that is a basic component of the present invention will be described, similarly to the first embodiment.

A different point from the first embodiment is that neither first ejection grooves 3*a* and second ejection grooves 3*b* nor first non-ejection grooves 4*a* and second non-ejection grooves 4*b* communicate. Another different point is that end portions of the first ejection grooves 3*a* and of the second ejection grooves 3*b*, and end portions of the first non-ejection grooves 4*a* and of the second non-ejection grooves 4*b* overlap in a reference direction K. Other configurations are similar to the first embodiment. Therefore, hereinafter, the different points will be mainly described, and description of the same configurations will not be repeated. The same portion or a portion having the same function is denoted with the same reference sign.

As illustrated in FIG. 3, the piezoelectric body substrate 2 includes a first groove array 5*a* in which long and narrow first ejection grooves 3*a* and long and narrow first non-ejection grooves 4*a* are alternately arrayed in the reference direction K, and a second groove array 5*b* in which long and narrow second ejection grooves 3*b* and long and narrow second non-ejection grooves 4*b* are alternately arrayed in the reference direction K, adjacent to each other. of the adjacent first and second groove arrays 5*a* and 5*b*, the other side end portions of the first ejection grooves 3*a* and one side end portions of the second non-ejection grooves 4*b* do not overlap in a thickness direction T of the piezoelectric body substrate 2. Similarly, of the adjacent first and second groove arrays 5*a* and 5*b*, the other side end portions of the first non-ejection grooves 4*a* and one side end portions of the second ejection grooves 3*b* do not overlap in the thickness direction T of the piezoelectric body substrate 2. Then, the other side end portions of the first ejection grooves 3*a* and the one side end portions of the second ejection grooves 3*b* overlap in the reference direction K. Similarly, the other side end portions of the first non-ejection groove 4*a* and the one side end portions of the second non-ejection grooves 4*b* overlap in the reference direction K.

As described above, the other side end portions of the first ejection grooves 3*a* and the one side end portions of the second ejection grooves 3*b*, and the other side end portions of the first non-ejection grooves 4*a* and the one side end portions of the second non-ejection grooves 4*b* respectively overlap in the reference direction K, so that the first groove array 5*a* and the second groove array 5*b* are closely adjacent. Accordingly, the ejection grooves are arranged with high density, and the number of the piezoelectric body substrates 2 to be taken from a piezoelectric body wafer is increased, whereby manufacturing cost can be decreased.

Specific description will be given with reference to FIGS. 4A and 4B. As illustrated in FIG. 4B, groove widths of the first and second ejection grooves 3*a* and 3*b*, and of the first and second non-ejection grooves 4*a* and 4*b* are narrower than a wall width of a side wall between the first ejection groove 3*a* and the first non-ejection groove 4*a*, and a wall width of a side wall between the second ejection groove 3*b* and the second non-ejection groove 4*b*. Then, the first ejection grooves 3*a* and the second ejection grooves 3*b*, and the first non-ejection grooves 4*a* and the second non-ejection grooves 4*b* are arranged not to communicate, and the first ejection grooves 3*a* and the second non-ejection grooves 4*b*, and the first non-ejection grooves 4*a* and the second ejection grooves 3*b* are arranged not to overlap in the thickness direction T of the piezoelectric body substrate 2. Further, as illustrated in FIG. 4A (a cross section of a BB portion of FIG. 4B), the other side end portions of the first ejection grooves 3*a* and the one side end portions of the second ejection grooves 3*b*, and the other side end portions of the first non-ejection grooves 4*a* and the one side end portions of the second non-ejection grooves 4*b* are arranged to overlap in the reference direction K. As a result, the first groove array 5*a* and the second groove array 5*b* are closely adjacent.

Note that the material of the piezoelectric body substrate 2, the shapes of the ejection grooves 3 and the non-ejection grooves 4 are similar to those of the first embodiment. Further, a closest approach distance between neither the first ejection groove 3*a* and the second non-ejection groove 4*b* nor the first non-ejection groove 4*a* and the second ejection groove 3*b* falls below 10 μm, which is similar to the first embodiment. Further, positional deviation between the first groove array 5*a* and the second groove array 5*b* in the reference direction K satisfies the expression (1).

(Third Embodiment)

Figure 7A:
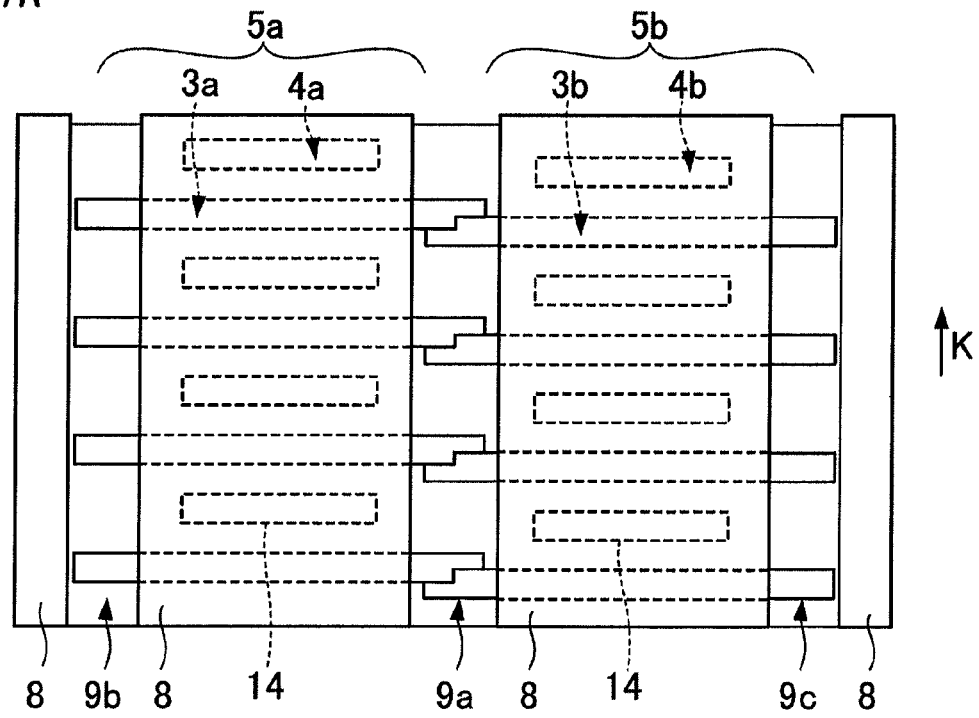
FIGS. 7A and 7B are explanatory diagrams of the liquid jet head according to the third embodiment of the present invention.
Figure 7B:
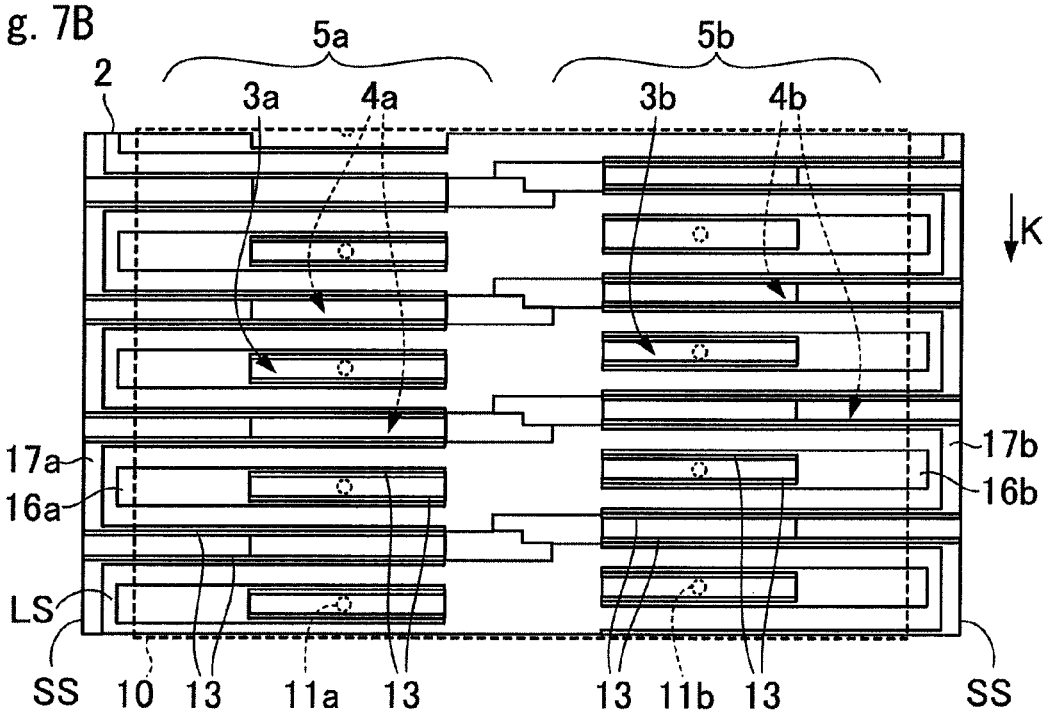

FIG. 5 is a schematic exploded perspective view of a liquid jet head 1 according to a third embodiment of the present invention. FIG. 6 is a schematic cross-sectional view of the liquid jet head 1 in a groove direction according to the third embodiment of the present invention. FIGS. 7A and 7B are explanatory diagrams of the liquid jet head 1 according to the third embodiment of the present invention. FIG. 7A is a schematic partial plan view of the liquid jet head 1 as viewed from a normal line of a cover plate 8, and FIG. 7B is a schematic partial plan view of a lower surface LS of a piezoelectric body substrate 2. A different point from the first embodiment is that the cover plate 8 is installed on an upper surface US of the piezoelectric body substrate 2, and a nozzle plate 10 is installed on the lower surface LS of the piezoelectric body substrate 2. Since the piezoelectric body substrate 2 has a similar structure to the first embodiment, detailed description will not be repeated. The same portion or a portion having the same function is denoted with the same reference sign.

As illustrated in FIG. 5, the liquid jet head 1 includes the piezoelectric body substrate 2 including a first groove array 5*a* and a second groove array 5*b*, the cover plate 8 including a liquid chamber 9, and the nozzle plate 10 including a nozzle 11. The cover plate 8 includes the liquid chamber 9 that communicates with first and second ejection grooves 3*a* and 3*b*, and the cover plate 8 is bonded on the upper surface US of the piezoelectric body substrate 2. The nozzle plate 10 includes a first nozzle array 12*a* in which nozzles 11*a* that communicate with the first ejection grooves 3*a* corresponding to the first groove array 5*a* are arrayed, and a second nozzle array 12*b* in which nozzles 11*b* that communicate with the second ejection grooves 3*b* corresponding to the second groove array 5*b* are arrayed, and the nozzle plate 10 is bonded on the lower surface LS of the piezoelectric body substrate 2.

The liquid chamber 9 includes a common liquid chamber 9*a*, and two individual liquid chambers 9*b* and 9*c*. The common liquid chamber 9*a* communicates with the other side end portions of the first ejection grooves 3*a* and one side end portions of the second ejection grooves 3*b*. Further, the individual liquid chamber 9*b* communicates with one side end portions of the first ejection grooves 3*a*. The individual liquid chamber 9*c* communicates with the other side end portions of the second ejection grooves 3*b*.

Here, the first and second non-ejection grooves 4*a* and 4*b* do not open to a region Ra (see FIG. 2B) of the upper surface US, to which the first ejection grooves 3*a* and the second ejection grooves 3*b* open. Therefore, it is not necessary to provide, in the common liquid chamber 9*a*, slits for allowing the first and second ejection grooves 3*a* and 3*b* to communicate, and for blocking the first and second non-ejection grooves 4*a* and 4*b*. A liquid flowing into the common liquid chamber 9*a* flows in the first ejection grooves 3*a* and flows out to the individual liquid chamber 9*b*, and flows in the second ejection groove 3*b* and flows out to the individual liquid chamber 9*c*, without flowing into the first and second non-ejection grooves 4*a* and 4*b*. Further, a part of the liquid flowing into the first and second ejection grooves 3*a* and 3*b* ejects through the nozzles 11*a* and 11*b* that respectively communicate with the first and second ejection grooves 3*a* and 3*b*.

Further, as illustrated in FIG. 7A, end portions of the first ejection grooves 3*a* at the side of the second groove array 5*b*, and end portions of the second ejection grooves 3*b* at the side of the first groove array 5*a* are favorably positioned within a region of an opening portion of the common liquid chamber 9*a* at the side of the piezoelectric body substrate 2. Similarly, end portions of the first ejection grooves 3*a* at an opposite side to the side of the second groove array 5*b*, and end portions of the second ejection grooves 3*b* at an opposite side to the side of the first groove array 5*a* are favorably positioned within regions of opening portions of the individual liquid chamber 9*b* and the individual liquid chamber 9*c* at the side of the piezoelectric body substrate 2, respectively. Accordingly, liquid pools within internal regions of the first and second ejection grooves 3*a* and 3*b*, and within flow paths of the common liquid chamber 9*a* and of the individual liquid chambers 9*b* and 9*c* are decreased, and accumulation of air bubbles can be decreased.

As illustrated in FIG. 6, drive electrodes 13 are not formed on side surfaces of the first and second ejection grooves 3*a* and 3*b*, and of the first and second non-ejection grooves 4*a* and 4*b*, the side surfaces being closer to the upper surface US than approximately ½ of the thickness of the piezoelectric body substrate 2. Therefore, the drive electrodes 13 are formed on side surfaces closer to the lower surface LS than approximately ½ of the thickness of the piezoelectric body substrate 2. Especially, the drive electrodes 13 installed on the side surfaces of the first or the second ejection groove 3*a* or 3*b* are positioned within a region of an opening portion 14 of the first or the second ejection groove 3*a* or 3*b*, in the groove direction, the opening portion 14 opening to the lower surface LS. Further, drive electrodes 13 formed on both of side surfaces of the first and second non-ejection grooves 4*a* and 4*b* are electrically separated to each other, and are extended to side surfaces SS of the piezoelectric body substrate 2.

Note that, in the present embodiment, an example of forming the drive electrodes 13 on lower halves of the grooves using the piezoelectric body substrate 2 to which polarization processing is uniformly applied in a vertical direction of the upper surface US or of the lower surface LS has been described. Alternatively, the drive electrodes 13 may be formed on upper halves of the grooves. Further, a Chevron-type piezoelectric body substrate 2 can be used, in which a piezoelectric body substrate to which the polarization processing is applied in the vertical direction of the upper surface US or the lower surface LS is adhered to a piezoelectric body substrate to which the polarization processing is applied in an opposite direction to the vertical direction. In this case, the drive electrodes 13 can be formed on side surfaces from a position upper than a polarization interface to the side of the lower surface LS, or from a position lower than the polarization interface to the side of the upper surface US.

As illustrated in FIG. 7B, the first non-ejection grooves 4*a* are extended to a one side surface SS of the piezoelectric body substrate 2, which is at an opposite side to the side of the second groove array 5*b*, and the drive electrodes 13 installed on the side surfaces of the first non-ejection grooves 4*a* are electrically separated and are extended to the one side surface SS of the piezoelectric body substrate 2. Similarly, the second non-ejection grooves 4*b* are extended to the other side surface SS of the piezoelectric body substrate 2 at an opposite side to the side of the first groove array 5*a*, and the drive electrodes 13 installed on the side surfaces of the second non-ejection grooves 4*b* are electrically separated and are extended to the other side surface SS of the piezoelectric body substrate 2. On the lower surface LS of the piezoelectric body substrate 2, a first common terminal 16*a* electrically connected to the drive electrodes 13 installed on both of the side surfaces of the first ejection groove 3*a*, and a first individual terminal 17*a* electrically connected to the drive electrodes 13 of the first non-ejection grooves 4*a* are installed. Further, on the lower surface LS of the piezoelectric body substrate 2, a second common terminal 16*b* electrically connected to the drive electrodes 13 of the second ejection groove 3*b*, and a second individual terminal 17*b* electrically connected to the drive electrodes 13 of the second non-ejection grooves 4*b* are installed. The first common terminal 16*a* and the first individual terminal 17*a* are installed in the vicinity of the one side end portion of the lower surface LS of the piezoelectric body substrate 2, and the second common terminal 16*b* and the second individual terminal 17*b* are installed in the vicinity of the other end portion of the lower surface LS of the piezoelectric body substrate 2. The first and second common terminals 16*a* and 16*b*, and the first and second individual terminals 17*a* and 17*b* are connected with a flexible circuit board (not illustrated) and are provided with a drive signal.

To be more specific, in the first groove array 5*a*, the drive electrodes 13 installed on both of the side surfaces of the first ejection groove 3*a* are connected to the first common terminal 16*a*. Two drive electrodes 13 installed on the side surfaces of two first non-ejection grooves 4*a* that interpose the first ejection groove 3*a*, the side surfaces being at the side of the first ejection groove 3*a*, are electrically connected through the first individual terminal 17*a*. The first individual terminal 17*a* is installed at the end portion of the lower surface LS of the piezoelectric body substrate 2, the end portion being at the side of the first groove array 5*a*, and the first common terminal 16*a* is installed on the lower surface LS between the first individual terminal 17*a* and the first ejection groove 3*a*. In the second groove array 5*b*, the second common terminal 16*b* and the second individual terminal 17*b* are installed similarly to the first common terminal 16*a* and the first individual terminal 17*a*.

Note that, in the present embodiment, the first and second common terminals 16*a* and 16*b*, and the first and second individual terminals 17*a* and 17*b* are installed on the lower surface LS of the piezoelectric body substrate 2, and are connected to a flexible circuit board (not illustrated) and can be supplied the drive signal. However, the present invention is not limited to the embodiment. For example, the nozzle plate 10 can be also used to function as the flexible circuit board, and the drive signal can be provided through the nozzle plate 10.

As illustrated in FIG. 6, when a region of the groove direction in which the cover plate 8 and the upper surface US of the piezoelectric body substrate 2 are bonded, between the common liquid chamber 9*a* and the individual liquid chamber 9*b* or 9*c*, is the bonding region jw, it is preferred to configure the drive electrodes 13, which are installed on the side surfaces of the first or the second ejection groove 3*a* or 3*b*, to be at the same position as a bonding region jw or to be included in the bonding region jw. Accordingly, a pressure wave can be efficiently evoked in the liquid inside the first or second ejection groove 3*a* or 3*b*.

The liquid jet head 1 is driven as follows. The liquid supplied to the common liquid chamber 9*a* flows into the first and second ejection grooves 3*a* and 3*b*, and fills in the first and second ejection grooves 3*a* and 3*b*. The liquid further flows out from the first ejection grooves 3*a* to the individual liquid chamber 9*b*, and from the second ejection grooves 3*b* to the individual liquid chamber 9*c*, and circulates. The polarization processing in the thickness direction T is applied to piezoelectric body substrate 2, in advance. For example, when liquid droplets are ejected through the nozzle 11*a* that communicates with the first ejection groove 3*a*, the drive signal is provided to the drive electrodes 13 and the both side walls of the first ejection groove 3*a* are subjected to thickness slip deformation, the volume of the first ejection groove 3*a* is changed, and the liquid droplets are ejected through the first nozzle 11*a* that communicates with the first ejection groove 3*a*. To be more specific, the drive signal is provided between the first common terminal 16*a* and the first individual terminal 17*a*, and the both side walls of the first ejection groove 3*a* is subjected to the thickness slip deformation. In practice, the first common terminal 16*a* is fixed to a potential of the GND level, and the drive signal is provided to the first individual terminal 17*a*. Note that the liquid may circulate to flow from the individual liquid chambers 9*b* and 9*c* and flow out from the common liquid chamber 9*a*, or may be supplied from all of the common liquid chamber 9*a* and the individual liquid chambers 9*b* and 9*c*.

Note that the liquid is not filled in the first and second non-ejection grooves 4*a* and 4*b*, and respective pieces of interconnection between the first and second individual terminals 17*a* and 17*b*, and the drive electrodes 13 installed on the side surfaces of the first and second non-ejection grooves 4*a* and 4*b* are not in contact with the liquid. Therefore, even if a conductive liquid is used, the drive signal applied between the first or second individual terminal 17*a* or 17*b* and the first or second common terminal 16*a* or 16*b* does not leak through the liquid, and a problem that the drive electrodes 13 or the interconnection are electrolyzed is not caused.

The piezoelectric body substrate 2 is configured as described above, the distance between the first groove array 5*a* and the second groove array 5*b* can be brought close together. Therefore, the ejection grooves can be arranged with high density, the number of the piezoelectric body substrate 2 to be taken from a piezoelectric body wafer can be increased, and the manufacturing cost can be decreased. As described in the first embodiment, when the thickness t1 of the piezoelectric body substrate 2 is formed into 360 μm, the length of a slope 6 of the ejection groove 3 in the groove direction becomes about 3.5 mm. The first ejection groove 3*a* and the second ejection groove 3*b* are configured to communicate, and to overlap in the reference direction K. Further, the first non-ejection groove 4*a* and the second non-ejection groove 4*b* are configured to communicate, and to overlap in the reference direction K. Accordingly, the first groove array 5*a* and the second groove array 5*b* are closely adjacent up to about 3.5 mm. If the thickness t1 is 300 μm, the length of the slope 6 in the groove direction becomes about 3.1 mm, and the first groove array 5*a* and the second groove array 5*b* can be closely adjacent up to about 3.1 mm. Considering installation of the liquid chamber 9 in the cover plate 8, and installation of the common terminals 16 and the individual terminals 17 on the piezoelectric body substrate 2, the width of the piezoelectric body substrate 2 is decreased more than the length of the overlapping portion, and the number of the piezoelectric body substrates to be taken from a piezoelectric body wafer can be increased.

Further, the first non-ejection grooves 4*a* and the second non-ejection grooves 4*b* do not open to a region Ra (see FIG. 2B) of the upper surface US where the other side end portions of the first ejection grooves 3*a* and the one side end portions of the second ejection grooves 3*b* communicate, or overlap in the reference direction K. Further, the first and second non-ejection grooves 4*a* and 4*b* do not open to a region Rb of the one side end portions of the first ejection groove 3*a* or to a region Rc of the other side end portions of the second ejection grooves 3*b*. Therefore, it is not necessary to provide slits to block the first non-ejection grooves 4*a* and the second non-ejection grooves 4*b*, and the structure of the cover plate 8 can be extremely simplified. Note that, in the present embodiment, the first and second common terminals 16*a* and 16*b* and the first and second individual terminals 17*a* and 17*b* are installed on the lower surface LS of the piezoelectric body substrate 2. However, alternatively, the first and second common terminals 16*a* and 16*b* and the first and second individual terminals 17*a* and 17*b* may be installed on the upper surface US of the piezoelectric body substrate 2. In this case, the drive electrodes 13 are at least installed on the side surfaces closer to the upper surface US than approximately ½ of the thickness of the grooves.

Further, the number of arrays of the groove arrays 5 is not limited to two, and can be three or more in the present invention. In this case, the requirement of the present invention is satisfied between the first groove array 5*a* and the second groove array 5*b*, and the requirement of the present invention can also be satisfied between the second groove array 5*b* and a third groove array 5*c* at the same time. In this case, a through electrode is formed in the nozzle plate 10 or the cover plate 8, and interconnection electrically connected to the common terminals 16 and the individual terminals 17 can be installed on an outer surface of the nozzle plate 10 or of the cover plate 8.

A method of manufacturing the liquid jet head 1 of the present invention will be described. With respect to the liquid jet head 1, first, in a process of forming ejection grooves, the piezoelectric body substrate 2 is cut from the side of the upper surface US of the piezoelectric body substrate 2 using a disk-like dicing blade, and a plurality of the first ejection grooves 3*a* and the second ejection grooves 3*b* is formed. Next, in a process of bonding the cover plate, the cover plate 8 is bonded on the upper surface US of the piezoelectric body substrate 2. On the cover plate 8, the common liquid chamber 9*a* and the individual liquid chambers 9*b* and 9*c* are formed, in advance. Next, in a process of grinding the lower surface of the substrate, the lower surface LS of the piezoelectric body substrate 2 is ground, and the first and second ejection grooves 3*a* and 3*b* are caused to open to the side of the lower surface LS. Next, in a process of forming the non-ejection grooves, the piezoelectric body substrate 2 is cut from the side of the lower surface LS of the piezoelectric body substrate 2 using the dicing blade, and a plurality of the first non-ejection grooves 4*a* and the second non-ejection groove 4*b* is formed.

Accordingly, the first groove array 5*a* in which the first ejection grooves 3*a* and the first non-ejection grooves 4*a* are alternately arrayed in the reference direction K, and the second groove array 5*b* in which the second ejection grooves 3*b* and the second non-ejection grooves 4*b* are alternately arrayed in the reference direction K are formed. Then, of the adjacent first and second groove arrays 5*a* and 5*b*, the other side end portions of the first ejection grooves 3*a* and the one side end portions of the second non-ejection grooves 4*b* do not overlap in the thickness direction T of the piezoelectric body substrate 2, and the other side end portions of the first ejection grooves 3*a* and the one side end portions of the second ejection grooves 3*b* communicate, or overlap in the reference direction K. Similarly, of the adjacent first and second groove arrays 5*a* and 5*b*, the other side end portions of the first non-ejection grooves 4*a* and the one side end portions of the second ejection grooves 3*b* do not overlap in the thickness direction T of the piezoelectric body substrate 2, and the other side end portions of the first non-ejection grooves 4*a* and the one side end portions of the second non-ejection grooves 4*b* communicate, or overlap in the reference direction K.

Next, in a process of depositing a conductive material, the conductive material is deposited on the side surfaces of the first and second ejection groove 3*a* and 3*b* and on the side surfaces of the first and second non-ejection grooves 4*a* and 4*b*, and a conductive film is formed, by an oblique vapor-deposition method, from the vertical direction of the lower surface LS of the piezoelectric body substrate 2. In this case, a mask is installed on the region Ra where the first ejection grooves 3*a* and the second ejection grooves 3*b*, and the first non-ejection grooves 4*a* and the second non-ejection grooves 4*b* communicate, or the first ejection grooves 3*a* and the second ejection grooves 3*b*, and the first non-ejection grooves 4*a* and the second non-ejection grooves 4*b* overlap in the reference direction K, so that the conductive material is not deposited. Next, in a process of forming a conductive film pattern, patterning of the conductive film is performed, and the common terminals 16 and the individual terminals 17 are formed. Next, in a process of bonding the nozzle plate, the nozzle plate 10 is bonded on the lower surface LS of the piezoelectric body substrate 2, and the nozzles 11 formed in the nozzle plate 10 and the ejection grooves 3 are caused to communicate, so that the liquid jet head 1 is completed.

(Fourth Embodiment)

Figure 8:
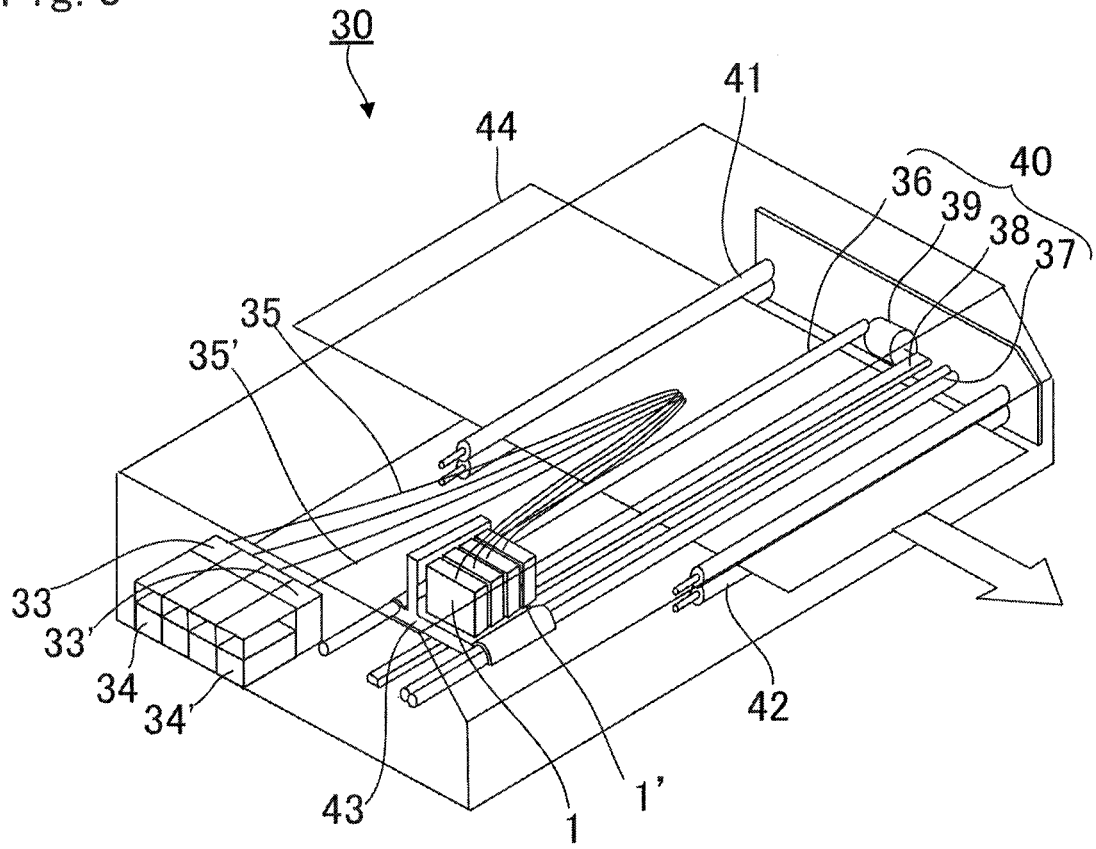
FIG. 8 is a schematic perspective view of a liquid jet apparatus according to a fourth embodiment of the present invention.
Figure 9A:
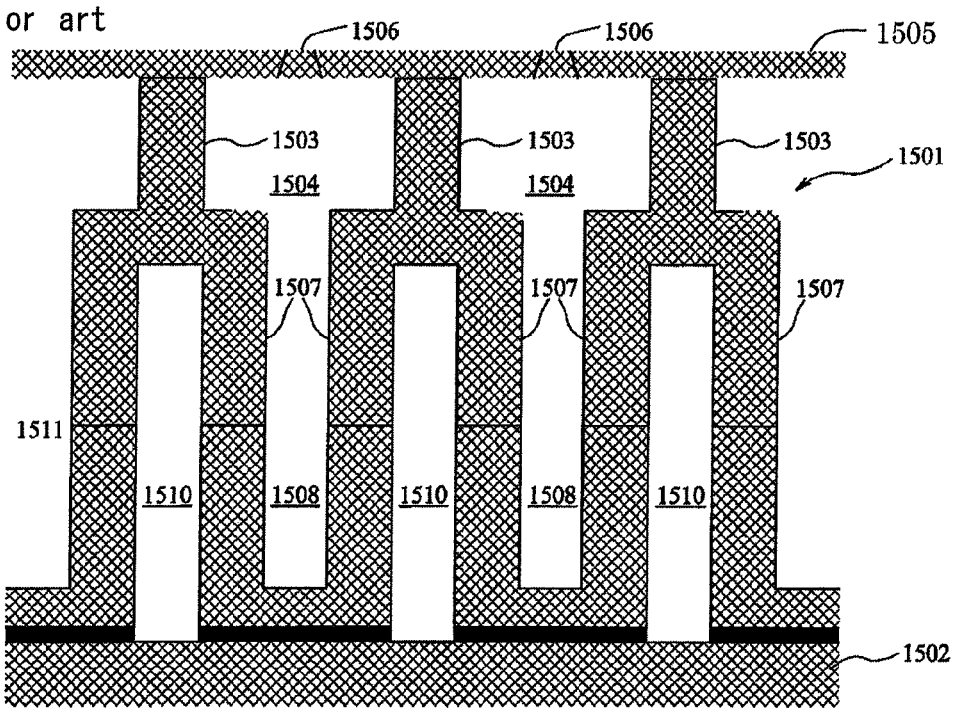
Fig. 9A Prior art
FIGS. 9A and 9B are explanatory diagrams of a conventionally known liquid jet head.
Figure 9B:
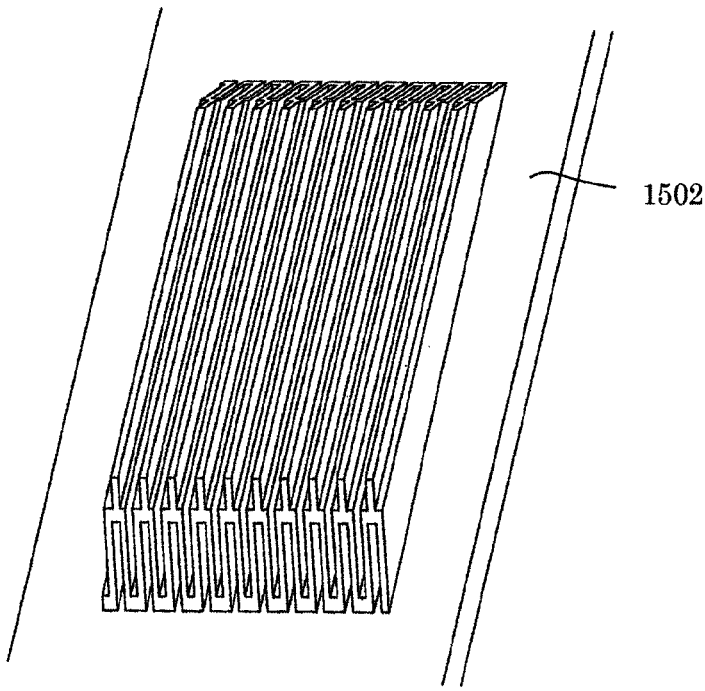
Fig. 9B Prior art

FIG. 8 is a schematic perspective view of a liquid jet apparatus 30 according to a fourth embodiment of the present invention. The liquid jet apparatus 30 includes a moving mechanism 40 that reciprocates liquid jet heads 1 and 1', flow path portions 35 and 35' that supplies a liquid to the liquid jet heads 1 and 1' and discharges the liquid from the liquid jet heads 1 and 1', liquid pumps 33 and 33' that communicate with the flow path portions 35 and 35', and liquid tanks 34 and 34'. Each of the liquid jet heads 1 and 1' includes a plurality of groove arrays adjacent to each other. The other side end portions of ejection grooves included in a one side groove array and one side end portions of non-ejection grooves included in the other side groove array do not overlap in a thickness direction of a piezoelectric body substrate, and the other side end portions of the ejection grooves included in the one side groove array and one side end portions of the ejection grooves included in the other side groove array communicate, or overlap in a reference direction. As the liquid jet heads 1 and 1', any of the liquid jet head already described in the first to third embodiments is used.

The liquid jet apparatus 30 includes a pair of conveyance units 41 and 42 that conveys a recording medium 44 such as a paper in a main scanning direction, the liquid jet heads 1 and 1' that eject the liquid toward the recording medium 44, a carriage unit 43 on which the liquid jet heads 1 and 1' are placed, the liquid pumps 33 and 33' that pressurize and supply the liquid stored in the liquid tanks 34 and 34' to the flow path portions 35 and 35', and the moving mechanism 40 that scans the liquid jet heads 1 and 1' in a sub-scanning direction perpendicular to the main scanning direction. A control unit (not illustrated) controls and drives the liquid jet heads 1 and 1', the moving mechanism 40, and the conveyance units 41 and 42.

The pair of conveyance units 41 and 42 extends in the sub-scanning direction, and includes a grid roller and a pinch roller that come in contact with a roller surface, and rotate on the roller surface. The conveyance units 41 and 42 move the grid roller and the pinch roller around axes with a motor (not illustrated) to convey the recording medium 44 sandwiched between the rollers into the main scanning direction. The moving mechanism 40 includes a pair of guide rails 36 and 37 extending in the sub-scanning direction, the carriage unit 43 slidable along the pair of guide rails 36 and 37, an endless belt 38 that couples and moves the carriage unit 43 in the sub-scanning direction, and a motor 39 that turns the endless belt 38 through a pulley (not illustrated).

The carriage unit 43 places the plurality of liquid jet heads 1 and 1', and ejects four types of liquid droplets, for example, yellow, magenta, cyan, and black. The liquid tanks 34 and 34' store the liquid of corresponding colors, and supply the liquids to the liquid jet heads 1 and 1' through the liquid pumps 33 and 33', and the flow path portions 35 and 35'. Each of the liquid jet heads 1 and 1' ejects the liquid droplet of each color according to a drive signal. The timing at which the liquids are ejected from the liquid jet heads 1 and 1', rotation of the motor 39 that drives the carriage unit 43, and a conveyance speed of the recording medium 44 are controlled, whereby an arbitrary pattern can be recorded on the recording medium 44.

Note that the present embodiment is the liquid jet apparatus 30 in which the moving mechanism 40 moves the carriage unit 43 and the recording medium 44 and performs recording. Alternatively, a liquid jet apparatus in which the carriage unit is fixed, and the moving mechanism moves the recording medium in a two-dimensional manner and performs recording may be employed. That is, the moving mechanism may just be one that relatively moves the liquid jet head and the recording medium.

What is claimed is:

1. A liquid jet head comprising:

a piezoelectric body substrate including two adjacent groove arrays in which a long and narrow ejection groove and a long and narrow non-ejection groove are alternately arrayed in a reference direction, wherein, an other side end portion of the ejection groove included in one groove array and a one side end portion of the non-ejection groove included in the other groove array do not overlap in a thickness direction of the piezoelectric body substrate, and the other side end portion of the ejection groove included in the one groove array and a one side end portion of the ejection groove included in the other groove array overlap each other in the reference direction, and the other side end portion of the ejection groove included in the one groove array slopes upwardly from a lower surface to an upper surface of the piezoelectric body substrate, and the one side end portion of the ejection groove included in the other groove array slopes upwardly from the lower surface to the upper surface and communicates with the other side end portion of the ejection groove included in the one groove array.

2. The liquid jet head according to claim 1, wherein, of the adjacent groove arrays, the other side end portion of the non-ejection groove included in the groove array of the one side, and the one side end portion of the non-ejection groove included in the groove array of the other side communicate, or overlap in the reference direction.

3. The liquid jet head according to claim 1, wherein the other side end portion of the non-ejection groove included in the one groove array slopes downwardly to the lower surface of the piezoelectric body substrate.

4. The liquid jet head according to claim 1, wherein, of the adjacent groove arrays, the one side end portion of the non-ejection groove included in the groove array of the one side open to a side surface of the piezoelectric body substrate.

5. The liquid jet head according to claim 1, wherein a closest approach distance between the ejection groove included in the groove array of the one side and the non-ejection groove included in the groove array of the other side does not fall below 10 μm.

6. The liquid jet head according to claim 1, further comprising a cover plate including a liquid chamber that communicates with the ejection groove, the cover plate being bonded on an upper surface of the piezoelectric body substrate.

7. The liquid jet head according to claim 6, wherein the liquid chamber includes a common liquid chamber that communicates with the other side end portion of the ejection groove included in the groove array of the one side.

8. The liquid jet head according to claim 6, wherein the liquid chamber includes an individual liquid chamber that communicates with the one side end portion of the ejection groove included in the groove array of the one side.

9. The liquid jet head according to claim 1, further comprising a nozzle plate that includes a plurality of nozzle arrays in which nozzles are arranged, the nozzles communicating with the ejection grooves corresponding to the groove arrays, and is bonded on a lower surface of the piezoelectric body substrate.

10. The liquid jet head according to claim 1, wherein drive electrodes of the ejection groove and of the non-ejection groove are not installed on side surfaces closer to an upper surface than approximately ½ of a thickness of the piezoelectric body substrate, and are thus installed on side surfaces closer to a lower surface than approximately ½ of the thickness of the piezoelectric body substrate.

11. The liquid jet head according to claim 10, wherein the drive electrode installed on the ejection groove is positioned, in a groove direction, within a region of an opening portion in the lower surface of the piezoelectric body substrate, to which the ejection groove opens.

12. A liquid jet apparatus comprising:

a liquid jet head according to claim 1;

a moving mechanism configured to relatively move the liquid jet head and a recording medium;

a liquid supply tube configured to supply a liquid to the liquid jet head; and a liquid tank configured to supply the liquid to the liquid supply tube.

13. A liquid jet head, comprising:

a piezoelectric substrate having first and second groove arrays each comprised of ejection grooves and non-ejection grooves each having opposite end portions and being alternately arrayed in a reference direction, the first and second groove arrays being arranged adjacent one another in the longitudinal direction of the grooves so that the ejection grooves in the first groove array are shifted in the reference direction relative to corresponding ones of the ejection grooves in the second groove array, wherein one end portions of the ejection grooves in the first groove array overlap in the reference direction, and communicate, with one end portions of the corresponding ejection grooves in the second groove array.

14. The liquid jet head according to claim 13, wherein the one end portions of the ejection grooves in the first and second groove arrays slope upwardly in a direction from a lower surface to an upper surface of the piezoelectric substrate.

15. The liquid jet head according to claim 14, wherein the ejection grooves in the first and second groove arrays penetrate from the upper surface to the lower surface of the piezoelectric substrate, and the length of the ejection grooves at the upper surface is longer than the length of the ejection grooves at the lower surface.

16. The liquid jet head according to claim 15, wherein the one end portions of the ejection grooves curve inwardly from the lower to the upper surfaces.

17. The liquid jet head according to claim 16, wherein both opposite end portions of the ejection grooves curve inwardly from the lower to the upper surfaces.

18. A liquid jet apparatus comprising:

a liquid jet head according to claim 13;

a moving mechanism configured to relatively move the liquid jet head and a recording medium;

a liquid supply tube configured to supply a liquid to the liquid jet head; and a liquid tank configured to supply the liquid to the liquid supply tube.

* * * * *